US008919327B2

(12) United States Patent
Pearce et al.

(10) Patent No.: US 8,919,327 B2
(45) Date of Patent: Dec. 30, 2014

(54) EVAPORATIVE EMISSION CONTROL

(76) Inventors: Russell Randall Pearce, Ann Arbor, MI (US); Niels Christopher Kragh, Commerce Township, MI (US); Scott A. Bohr, Plymouth, MI (US); Mark Bunge, Dearborn, MI (US); Mark W. Peters, Wolverine Lake, MI (US)

( * ) Notice: Subject to any disclaimer, the term of this patent is extended or adjusted under 35 U.S.C. 154(b) by 241 days.

(21) Appl. No.: 13/466,528

(22) Filed: May 8, 2012

(65) Prior Publication Data

US 2013/0298879 A1 Nov. 14, 2013

(51) Int. Cl.
*F02M 33/04* (2006.01)
*F02D 41/00* (2006.01)
*F02M 33/00* (2006.01)

(52) U.S. Cl.
CPC ..... *F02D 41/003* (2013.01); *F02M 25/0824* (2013.01)
USPC ..... 123/520; 123/519

(58) Field of Classification Search
CPC . F02D 41/003; F02D 25/0872; F02D 25/089; F02M 25/0836; F02M 25/0854
USPC ..... 123/520, 516, 518, 519, 698; 137/587–589
See application file for complete search history.

(56) References Cited

U.S. PATENT DOCUMENTS

| | | | | |
|---|---|---|---|---|
| 4,894,072 | A | 1/1990 | Turner et al. | |
| 5,111,795 | A * | 5/1992 | Thompson | 123/519 |
| 5,398,660 | A | 3/1995 | Koyama et al. | |
| 5,564,398 | A | 10/1996 | Maeda et al. | |
| 5,634,450 | A * | 6/1997 | Hara et al. | 123/519 |
| 2009/0007890 | A1 * | 1/2009 | Devries et al. | 123/520 |
| 2011/0168025 | A1 * | 7/2011 | Huynh | 96/126 |

FOREIGN PATENT DOCUMENTS

JP 2006046144 A * 2/2006

OTHER PUBLICATIONS

Kragh, Niels Christopher et al., "Evaporative Emission Control," U.S. Appl. No. 13/670,675, filed Nov. 7, 2012, 42 pages.

* cited by examiner

*Primary Examiner* — Mahmoud Gimie
(74) *Attorney, Agent, or Firm* — Julia Voutyras; Alleman Hall McCoy Russell & Tuttle LLP

(57) ABSTRACT

A method for operating a fuel system is disclosed. The method includes sequentially purging fuel vapors from each of a plurality of regions of a canister. Purging a region includes opening an air inlet valve associated with that region and maintaining air inlet valves associated with each other region closed to direct fuel vapors to at least one purge outlet.

15 Claims, 5 Drawing Sheets

EVAPORATIVE EMISSION CONTROL

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs and stores the fuel vapors. At a later time, when the engine is in operation, the evaporative emission control system allows the fuel vapors to be purged into the engine intake manifold from the fuel vapor canister to be consumed during combustion.

In one example described in U.S. Pat. No. 5,398,660, a fuel vapor canister includes a plurality of purge valves and a plurality of air inlet valves. During operation of the engine, all of the purge valves and the air inlet valves may be opened to supply a negative pressure from an engine air induction passage to within the canister. As a result of the supply of the vacuum, fuel vapor is purged to the intake manifold of the engine from the fuel vapor canister.

However, the inventors herein have recognized issues with the above approach. For example, in engine applications that operate with low vacuum air induction, by opening all air inlet and purge valves of the fuel vapor canister at the same time, a small amount of vacuum may be created in the fuel vapor canister. Accordingly, the amount of time it takes for the fuel vapor canister to be purged may be substantial. More particularly, in hybrid electric vehicle (HEV) applications, the engine run time may be shorter than the amount of time it takes to purge the fuel vapor canister with low vacuum.

Thus, in one example, the above issues may be addressed by a method for operating a fuel system comprising: sequentially purging fuel vapors from each of a plurality of regions of a canister. Specifically, purging a region of the canister may include opening an air inlet valve associated with that region and maintaining air inlet valves associated with each other region of the canister closed in order to direct fuel vapors to at least one purge outlet of the canister.

In one example, a region of the canister may be purged until a fuel fraction of combustion gases exhausted from the cylinders is less than a set point. Once a region has been purged to the set point, the associated air inlet valve may be closed and an air inlet valve associated with a next region in the sequence may be opened while maintaining each of the other air inlet valves closed to purge that region.

By opening one air inlet valve at a time, air flow through the region of the canister associated with that air inlet valve may be increased to more quickly purge fuel vapors from that region to meet the set point. In this way, the amount of time to purge the canister may be reduced relative to the approach where all valves are opened at the same time. Moreover, the increased air flow may purge the region more thoroughly relative to a purge approach with lower air flow. In other words, the increased air flow may increase the likelihood of attaining zero bleed emissions from the canister.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description relates to controlling evaporative emissions in a vehicle. More particularly, the present disclosure relates to fuel vapor purging by sequentially purging different regions of a fuel vapor canister. By sequentially purging each region of the fuel vapor canister one at a time, air flow through that region may be increased to more quickly and thoroughly purge that region relative to an approach where the entire canister is purged all at once. Such an approach may be applicable to low vacuum air induction engine applications. Furthermore, such an approach may be applicable to hybrid electric vehicle (HEV) applications and other applications with limited engine run time.

Figure 1:
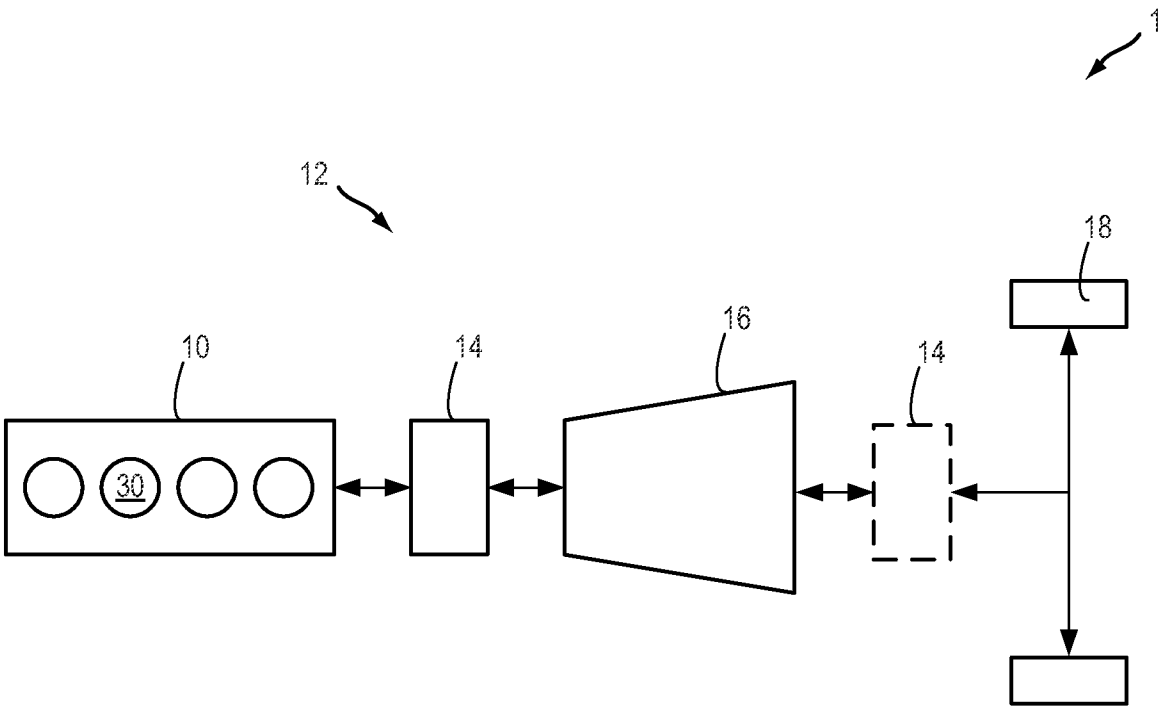
FIG. 1 schematically shows an example of a hybrid propulsion system according to an embodiment of the present disclosure.

FIG. 1 schematically shows an example of a vehicle system 1 according to an embodiment of the present disclosure. The vehicle 1 includes a hybrid propulsion system 12. The hybrid propulsion system 12 includes an internal combustion engine 10 having one or more cylinders 30, a transmission 16, drive wheels 18 or other suitable device for delivering propulsive force to the ground surface, and one or more motors 14. In this way, the vehicle may be propelled by at least one of the engine or the motor.

In the illustrated example, one or more of the motors 14 may be operated to supply or absorb torque from the driveline with or without torque being provided by the engine. Accordingly, the engine 10 may operate on a limited basis. Correspondingly, there may be limited opportunity for fuel vapor purging to control evaporative emissions. It will be appreciated that the vehicle is merely one example, and still other configurations are possible. Therefore, it should be appreciated that other suitable hybrid configurations or variations thereof may be used with regards to the approaches and methods described herein. Moreover, the systems and methods described herein may be applicable to non-HEVs, such as vehicles that do not include a motor and are merely powered by an internal combustion.

Figure 2:
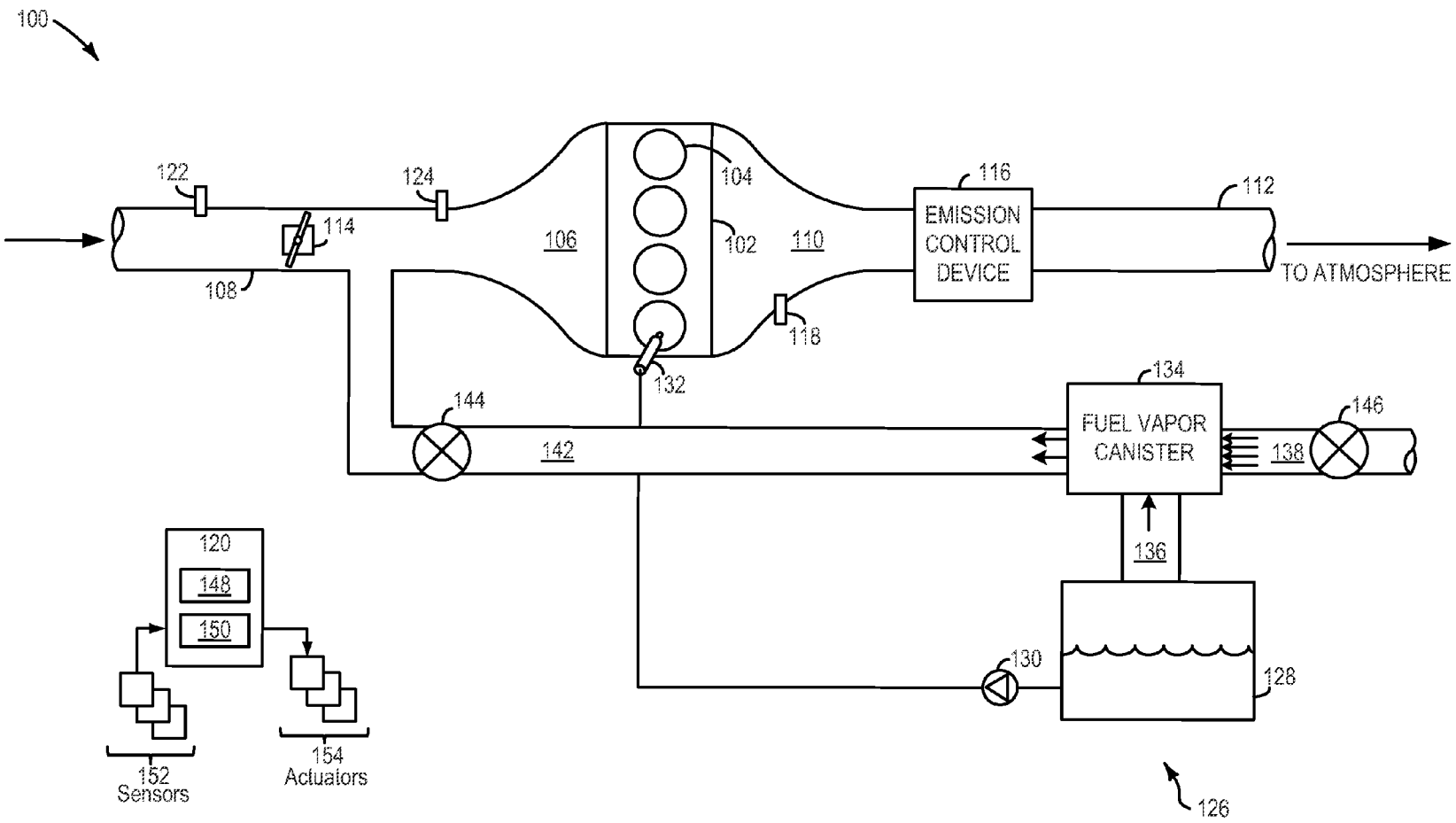
FIG. 2 schematically shows an example of an engine and an associated fuel system according to an embodiment of the present disclosure.

FIG. 2 schematically shows an example of an engine system 100 according to an embodiment of the present disclosure. For example, the engine system 100 may be implemented in the vehicle system 1 shown in FIG. 1. The engine system 100 includes an engine block 102 having a plurality of cylinders 104. The cylinders 104 may receive intake air from an intake manifold 106 via an intake passage 108 and may exhaust combustion gases to an exhaust manifold 110 and further to the atmosphere via exhaust passage 112.

The intake passage 108 includes a throttle 114. In this particular example, the position of the throttle 114 may be varied by a controller 120 via a signal provided to an electric motor or actuator included with the throttle 114, a configuration that is commonly referred to as electronic throttle control (ETC). In this manner, the throttle 114 may be operated to vary the intake air provided to the plurality of cylinders 104. The intake passage 108 may include a mass air flow sensor 122 and a manifold air pressure sensor 124 for providing respective signals MAF and MAP to the controller 120.

An emission control device 116 is shown arranged along the exhaust passage 112. The emission control device 116 may be a three way catalyst (TWC), NOx trap, various other emission control devices, or combinations thereof. In some embodiments, during operation of the engine 100, the emission control device 116 may be periodically reset by operating at least one cylinder of the engine within a particular air/fuel ratio. An exhaust gas sensor 118 is shown coupled to the exhaust passage 112 upstream of the emission control device 116. The sensor 118 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. It will be appreciated that the engine system 100 is shown in simplified form and may include other components.

A fuel injector 132 is shown coupled directly to the cylinder 104 for injecting fuel directly therein in proportion to a pulse width of a signal received from the controller 120. In this manner, the fuel injector 132 provides what is known as direct injection of fuel into the cylinder 104. The fuel injector may be mounted in the side of the combustion chamber or in the top of the combustion chamber, for example. Fuel may be delivered to the fuel injector 132 by a fuel system 126. In some embodiments, cylinder 104 may alternatively or additionally include a fuel injector arranged in intake manifold 106 in a configuration that provides what is known as port injection of fuel into the intake port upstream of the cylinder 104.

The fuel system 126 includes a fuel tank 128 coupled to a fuel pump system 130. The fuel pump system 130 may include one or more pumps for pressurizing fuel delivered to the injectors 132 of the engine 100, such as the fuel injector 132. While only a single injector 132 is shown, additional injectors are provided for each cylinder. It will be appreciated that fuel system 126 may be a return-less fuel system, a return fuel system, or various other types of fuel system.

Vapors generated in the fuel system 126 may be directed to an inlet of a fuel vapor canister 134 via a vapor recovery line 136. The fuel vapor canister may be filled with an appropriate adsorbent to temporarily trap fuel vapors (including vaporized hydrocarbons) during fuel tank refilling operations and "running loss" (that is, fuel vaporized during vehicle operation). In one example, the adsorbent used is activated charcoal. The fuel vapor canister 134 may be fluidly coupled to a vent line 138 via a plurality of air inlet valves 140. The plurality of air inlet valves 140 may be independently operable to fluidly couple different regions of the fuel vapor canister 134 with the vent line 138. Under some conditions, the vent line 138 may route gases out of the fuel vapor canister 134 to the atmosphere, such as when storing, or trapping, fuel vapors of the fuel system 126. Additionally, the vent line 138 may also allow fresh air to be drawn into the fuel vapor canister 134 when purging stored fuel vapors through one or more purge outlets of the fuel vapor canister to the intake manifold 106 via a purge line 142. A purge valve 144 may be positioned in the purge line and may be controlled by the controller 120 to regulate flow from the fuel vapor canister to the intake manifold 106. A vent valve 146 may be positioned in the vent line and may be controlled by the controller 120 to regulate the flow of air and vapors between the fuel vapor canister 134 and the atmosphere.

The controller 120 is shown in FIG. 1 as a microcomputer, including microprocessor unit 148, input/output ports, a computer readable storage medium 150 for executable programs and calibration values (e.g., read only memory chip, random access memory, keep alive memory, etc.) and a data bus. Storage medium read-only memory 150 can be programmed with computer readable data representing instructions executable by the processor 148 for performing the methods described below as well as other variants that are anticipated but not specifically listed.

The controller 120 may receive information from a plurality of sensors 152 of the engine system 100 that correspond to measurements such as inducted mass air flow, engine coolant temperature, ambient temperature, engine speed, throttle position, manifold absolute pressure signal, air/fuel ratio, fuel fraction of intake air, fuel tank pressure, fuel canister pressure, etc. Note that various combinations of sensors may be used to produce these and other measurements. Furthermore, the controller 120 may control a plurality of actuators 154 of the engine 100 based on the signals from the plurality of sensors 152. Examples of actuators 154 may include air inlet valves 140, purge valve 144, vent valve 146, throttle 114, fuel injector 132, etc.

In one example, the controller 120 includes computer readable medium 150 having instructions that when executed by the processor 148: sequentially purge fuel vapors from each of a plurality of regions of the fuel vapor canister 134 in response to a fuel tank filling event. In particular, purging a region may include opening an air inlet valve associated with that region and maintaining air inlet valves associated with each other region closed to direct fuel vapors from that region to a purge outlet of the fuel vapor canister 134. In other words, one air inlet valve may be opened at a time during purging of a region. By opening one air inlet valve at a time, air flow through the region of the fuel vapor canister nearest to the open air inlet valve may be increased relative to when all air inlet valves are open. The increased air flow may more quickly and thoroughly purge fuel vapors from that region. This may be particularly beneficial in low vacuum air induction engine systems and engines having shortened run time, such as with HEVs.

In one example, each region of the fuel vapor canister is purged until a fuel fraction of combustion gases exhausted from the cylinders is less than a set point. Once the set point for a region is achieved, the corresponding air inlet valve may be closed and an air inlet valve of the next region in the sequence may be opened while maintaining the other air inlet valves closed to purge that region, and so on until all regions of the fuel vapor canister are purged. In some embodiments, when the plurality of regions of the fuel vapor canister are purged the sequence may be repeated. In some embodiments, the sequence may be repeated responsive to the next fuel filling event. In some embodiments, the sequence may be repeated based on changes in environmental conditions, such as a change in temperature beyond a set point. It will be appreciated that the regions of the fuel vapor canister may be purged according to any suitable sequence without departing from the scope of the present disclosure.

In one example, the controller includes a processor and computer readable medium having instructions that when executed by the processor: during purging of the canister, increase vacuum in a designated region relative to each other region in the canister to direct fuel vapors in the designated region to the at least one purge outlet. Vacuum may be increased in the designated region by opening an air inlet valve associated with the designated region and closing air inlet valves associated with each other region. The controller may increase vacuum in the designated region responsive to a fuel tank filling event. Vacuum may be increased in the designated region until a fuel fraction of combustion gases exhausted from cylinders becomes less than a set point. Once the designated region is purged to the set point, the controller may designate another region for purging and increase the vacuum in that region relative to the other regions to purge that region, and so on until all regions are purged.

Figure 3:
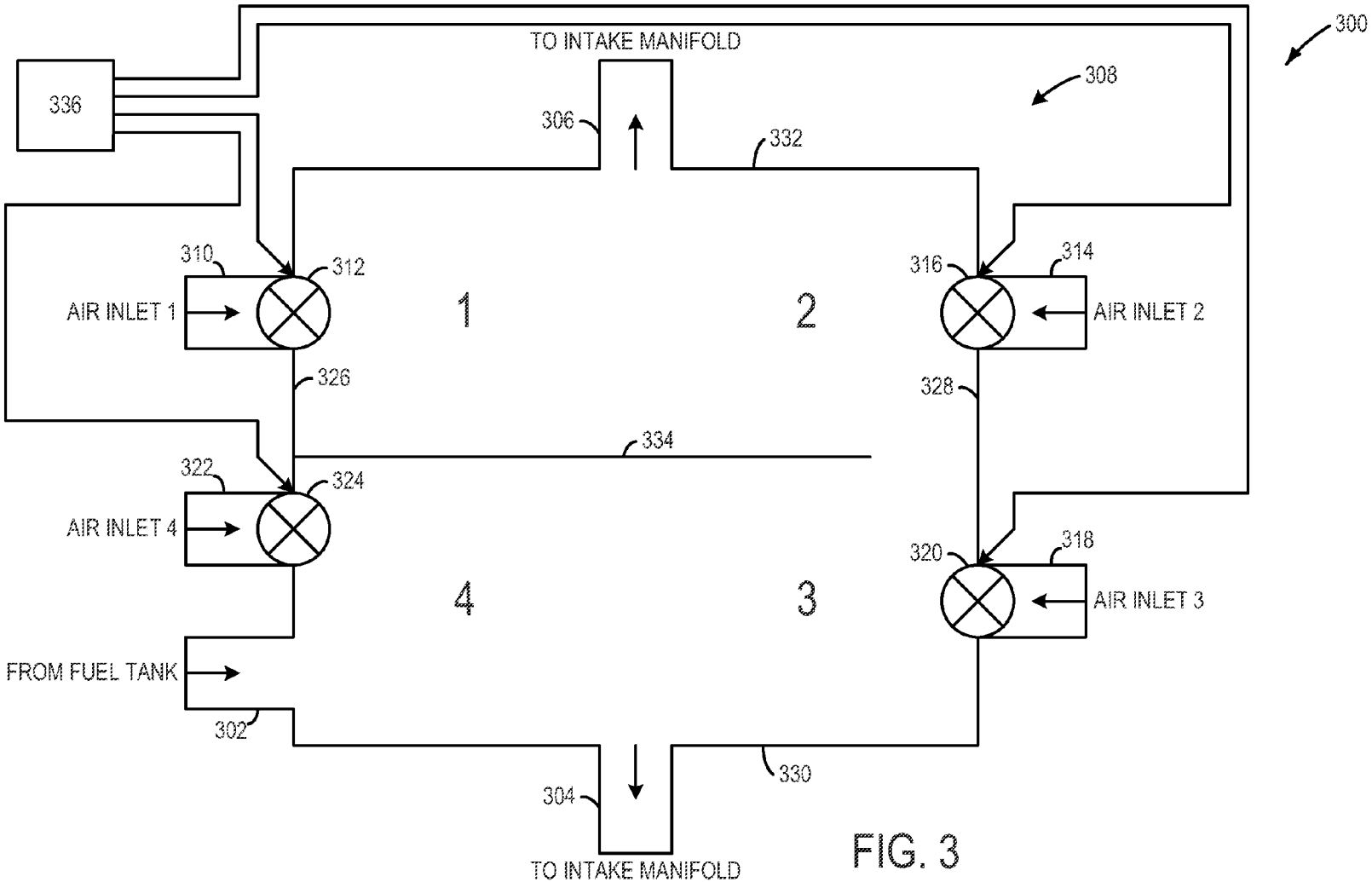
FIG. 3 schematically shows an example of a fuel vapor canister according to an embodiment of the present disclosure.

FIG. 3 schematically shows an example of a fuel vapor canister 300 according to an embodiment of the present disclosure. In one example, the canister 300 may be implemented in the engine system 100 shown in FIG. 2. The canister 300 includes a canister inlet fluidly coupled with a fuel tank (e.g., fuel tank 128 shown in FIG. 2). The canister inlet 302 permits fuel vapors that escape from the fuel tank to enter the canister 300 for storage. In one example, the canister 300 is filled with activated charcoal to store fuel vapors. In some embodiments, the canister may include more than one canister inlet.

The canister 300 includes a first purge outlet 304 and a second purge outlet 306 fluidly coupled with an intake manifold (e.g., intake manifold 106 shown in FIG. 2). The first and second purge outlets 304 and 306 permit fuel vapors to travel to the intake manifold from the canister 300 during purging, so that the fuel vapors can be consumed by combustion instead of being vented to the atmosphere. The canister 300 includes a plurality of regions 308 (e.g., 1, 2, 3, 4) that may store fuel vapors. The plurality of regions 308 may be sequentially purged one at a time according to a fuel purging method discussed in further detail below. In the illustrated embodiment, the first purge outlet and the second purge outlet are located on opposing sides of the canister. Specifically, the first purge outlet 304 is located on a first side 330 and the second purge outlet is located on a second side 332 that opposes the first side 330. The purge outlets may be positioned on opposing sides in order to facilitate the purging of fuel vapors from the different regions of the canister in substantially the same or similar manner. In other words, no region is positioned farther away from a purge outlet then any other region in the canister. Accordingly, the amount of time it takes to purge each region may be similar or substantially the same. It will be appreciated that the canister may include any suitable number of purge outlets that may be located in any suitable position on the canister without departing from the scope of the present disclosure.

The canister 300 includes a plurality of air inlet valves associated with the plurality of regions 308. In the illustrated embodiment, the canister includes four regions and four air inlet valves corresponding to the four regions. Specifically, a first air inlet valve 312 controls air flow through a first air inlet 310 to a first region; a second air inlet valve 316 controls air flow through a second air inlet 314 to a second region; a third air inlet valve 320 controls air flow through a third air inlet 318 a third region; and a fourth air inlet valve 324 controls air flow through a fourth air inlet 322 to a fourth region. Each air inlet may be positioned such that during purging of a region air flows from that air inlet through the region to the nearest purge outlet.

In the illustrated embodiment, two pairs of air inlet valves are located on opposing sides of the canister. Specifically, the first air inlet valve 312 and the fourth air inlet valve 314 are positioned on a side 326 and the second air inlet valve 316 and the third air inlet valve 320 are positioned on a side 328 that opposes side 326. Furthermore, the first and second purge outlets 304 and 306 are located on different sides of the canister from the plurality of inlet valves. In this way, air flowing through any air inlet valve flows through a corresponding region of the canister to reach a purge outlet. In one example, a region corresponds to an air inlet valve if air from the air inlet valve travels through the region to reach a purge outlet. In some embodiments, the canister 300 may include a dividing wall 334 that may partially divide the regions of the canister. The dividing wall 334 may help direct air flow through a particular region during purging by at least partially blocking access to other regions of the canister. It will be appreciated that the canister may include any suitable number of air inlet valves that may be located in any suitable position on the canister without departing from the scope of the present disclosure.

Each of the plurality of air inlet valves may be controlled by controller 336. In one example, the controller 336 is the controller 120 shown in FIG. 2. Each of the plurality of air inlet valves may be individually operable by the controller 336 to purge fuel vapors from an associated region to a purge outlet. In other words, the controller 336 may be configured to open one air inlet valve and close the other air inlet valves in order to purge a particular region of the canister. FIGS. 4-7 show an example of different regions of the fuel vapor canister 300 being sequentially purged. In these examples, the sequence in which the regions of the canister are purge is 1-4. Although it will be appreciated that any suitable purging sequence may be implemented without departing from the scope of the present disclosure.

Figure 4:
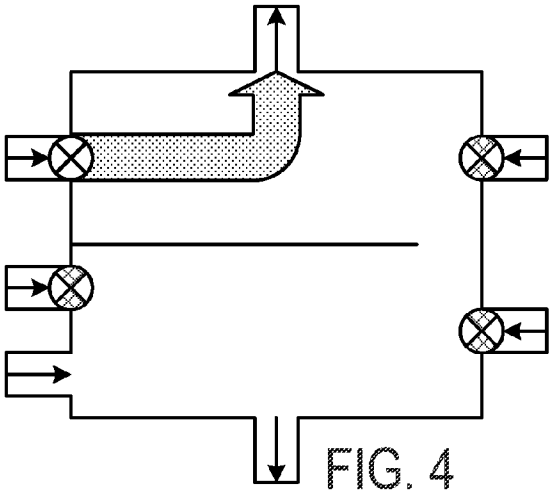

FIG. 4 shows the first region being purged. Specifically, the first air inlet valve is opened and the other air inlet valves are closed so that air travels from the first air inlet valve, through the first region, to the second purge outlet. Once the first region is purged, for example, such that a fuel fraction is less than a set point, the next region in the sequence may be purged.

Figure 5:
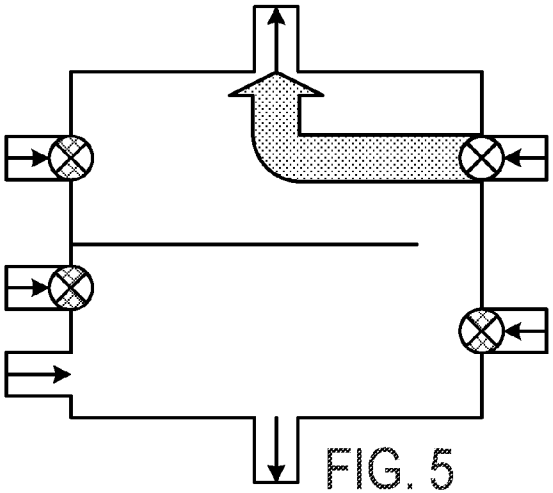
FIGS. 4-7 show an example of different regions of a fuel vapor canister being sequentially purged.

FIG. 5 shows the second region being purged. Specifically, the second air inlet valve is opened and the other air inlet valves are closed so that air travels from the second air inlet, through the second region, to the second purge outlet. Once the second region is purged, for example, such that a fuel fraction is less than a set point, the next region in the sequence may be purged.

Figure 6:
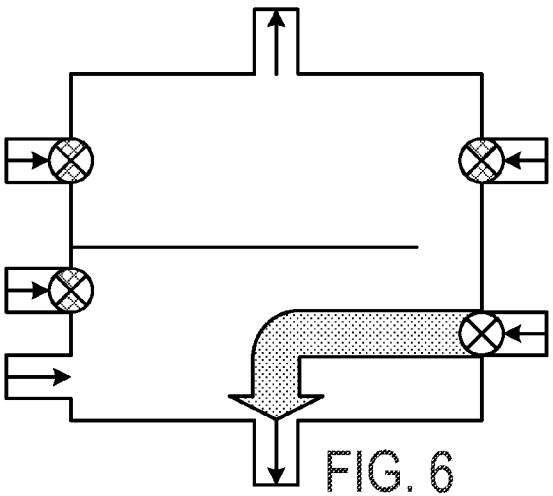

FIG. 6 shows the third region being purged. Specifically, the third air inlet valve is opened and the other air inlet valves are closed so that air travels from the third air inlet, through the third region, to the first purge outlet. Once the third region is purged, for example, such that a fuel fraction is less than a set point, the next region in the sequence may be purged.

Figure 7:
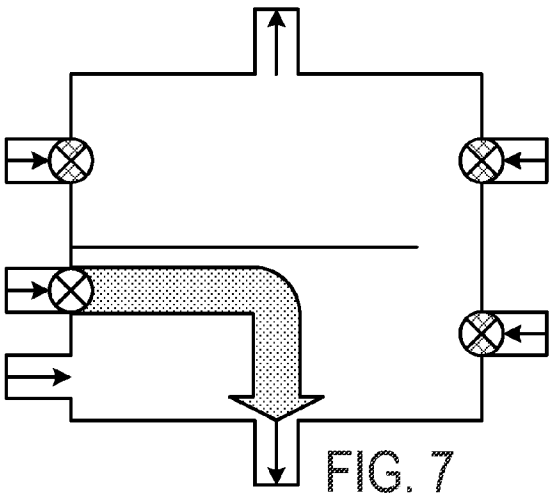

FIG. 7 shows the fourth region being purged. Specifically, the fourth air inlet valve is opened and the other air inlet valves are closed so that air travels from the fourth air inlet, through the fourth region, to the first purge outlet. Once the fourth region is purged, for example, such that a fuel fraction is less than a set point, purging may end or the sequence may be repeated.

Figure 8:
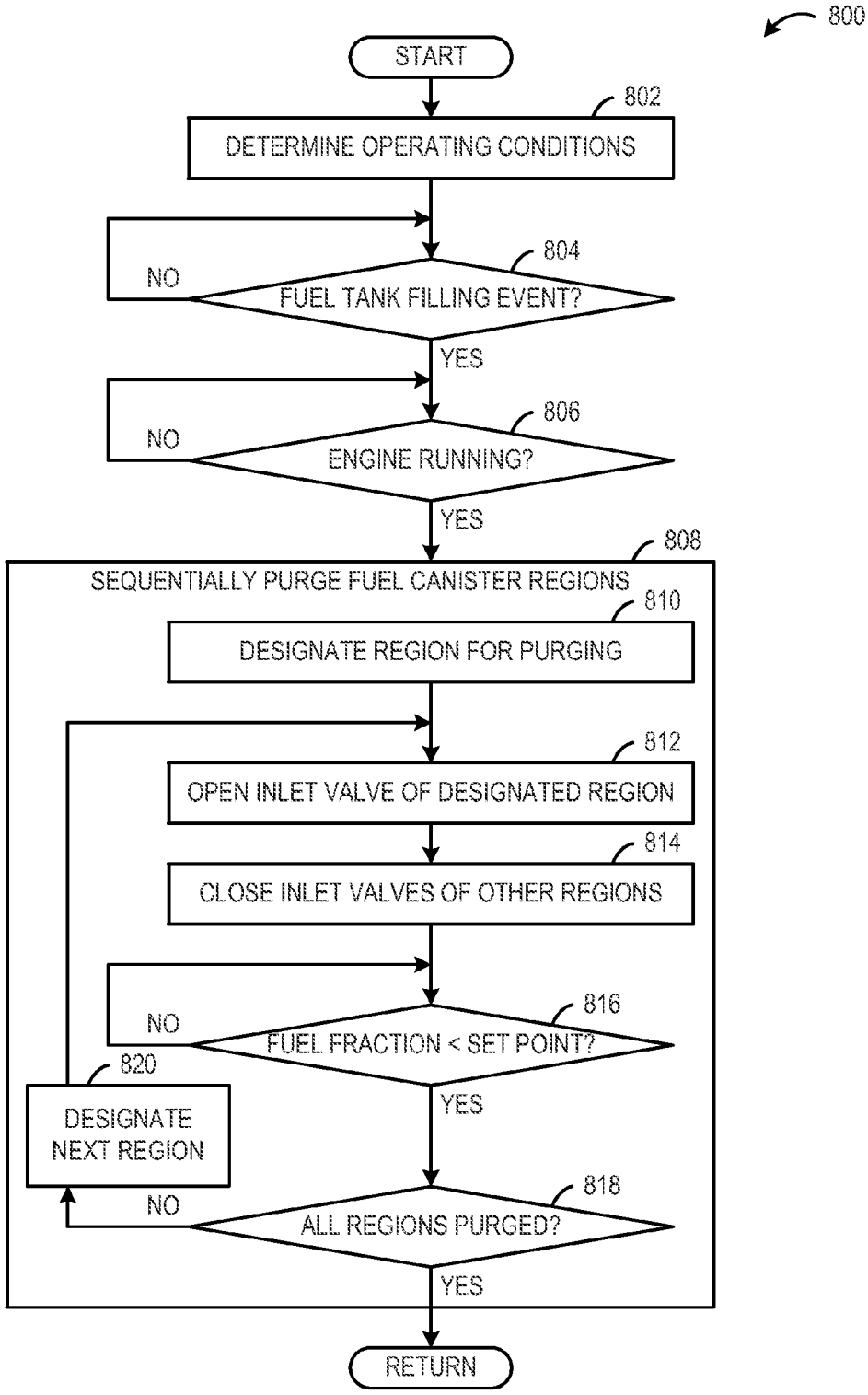
FIG. 8 shows an example of a method for controlling a fuel system according to an embodiment of the present disclosure.

FIG. 8 shows an example of a method 800 for controlling a fuel system according to an embodiment of the present disclosure. For example, the method 800 may be performed by the controller 120 shown in FIG. 2 or the controller 336 shown in FIG. 3

At 802, the method 800 includes determining operating conditions. Determining operating conditions may include receive signals from sensors indicative of various operating conditions, such as air/fuel ratio, fuel fraction, engine operation, fuel tank pressure, fuel tank filling event, etc.

At 804, the method 800 includes determining whether a fuel tank filling event has occurred. If a fuel filling event has occurred, then the method 800 moves to 806. Otherwise, the method 800 returns to 804.

At 806, the method 800 includes determining whether the engine is running. If the engine is running, then the method 800 moves to 8-6. Otherwise, the method 800 returns to 806.

At 808, the method 800 includes sequentially purging a plurality of regions of a fuel vapor canister. The canister may be purged responsive to a fuel filling event because when the fuel tank is filled with liquid fuel, fuel vapors residing in the fuel tank may be pushed into the fuel vapor canister to fill the fuel vapor canister. Moreover, the canister may be purged when the engine is running so that fuel vapors can be used for combustion instead of being vented to the atmosphere. More particularly, at 810, the method 800 includes designating a region of the canister for purging.

At 812, the method 800 includes opening an air inlet valve associated with the designated region.

At 814, the method 800 includes closing other air inlet valves of the canister. Note closing may include maintaining valves in a closed state, so that one air inlet valve is open at a time. By opening the air inlet valve associated with the designated region and closing the other air inlet valves, vacuum in the designated region may be increased relative to the other regions of the canister. The vacuum may be increased in the designated region to direct air flow from the open air inlet valve, through the designated region, to a closest purge outlet to purge fuel vapors from the designated region.

At 816, the method 800 includes determining if a fuel fraction of combustion gases exhausted from the cylinders is less than a set point. If the fuel fraction is less than the set point, then the method moves to 818. Otherwise, the method returns to 816.

At 818, the method 800 includes determining if all regions of the canister have been purged. If all regions of the canister have been purged, then the method returns to other operations. Otherwise, the method moves to 820.

At 820, the method 800 includes designating the next region in the sequence to be purged. Once the next region has been designated steps 812-814 are repeated for that region, and so on until all regions of the canister have been purged.

By sequentially purging each region of the fuel vapor canister one at a time, air flow through that region may be increased to more quickly and thoroughly purge that region relative to an approach where the entire canister is purged all at once. Such an approach may be applicable to low vacuum air induction engine applications. Furthermore, such an approach may be applicable to hybrid electric vehicle (HEV) applications and other applications with limited engine run time.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and nonobvious combinations and subcombinations of the various systems and configurations, and other features, functions, and/or properties disclosed herein.

The invention claimed is:

1. A method for operating a fuel system comprising:

sequentially purging fuel vapors from each of four regions of a canister, where purging a region includes opening an air inlet valve associated with each region and maintaining air inlet valves associated with each other region closed to direct fuel vapors to at least one purge outlet, where two pairs of air inlet valves are located on opposing sides of the canister.

2. The method of claim 1, wherein sequentially purging is performed responsive to a fuel tank filling event.

3. The method of claim 1, wherein purging the region includes opening the air inlet valve associated with the region and closing air inlet valves associated with each other region until a fuel fraction of combustion gases exhausted from cylinders is less than a set point.

4. The method of claim 3, wherein fuel vapors are purged from each region until the fuel fraction becomes less than the set point, and when the plurality of regions are purged the sequence is repeated.

5. A method for operating a fuel system comprising:

sequentially purging fuel vapors from each of a plurality of regions of a canister, where purging a region includes opening an air inlet valve associated with that region and maintaining air inlet valves associated with each other region closed to direct fuel vapors to at least one purge outlet, the canister including two purge outlets located on opposing sides of the canister.

6. The method of claim 5, wherein at least one purge outlet is located on a different side of the canister from a plurality of air inlet valves.

7. A fuel system comprising:

a fuel tank;

a canister for storing fuel vapors including a canister inlet fluidly coupled with the fuel tank;

a plurality of air inlet valves associated with a plurality of regions of the canister; and at least one purge outlet fluidly coupled with an intake manifold; and a controller including a processor and computer readable medium having instructions that when executed by the processor:

during purging of the canister, increase vacuum in a designated region relative to each other region in the canister to direct fuel vapors in the designated region to the at least one purge outlet, wherein vacuum is increased in the designated region until a fuel fraction of combustion gases exhausted from cylinders becomes less than a set point.

8. The fuel system of claim 7, wherein the controller increases vacuum in the designated region responsive to a fuel tank filling event.

9. The fuel system of claim 7, wherein vacuum is increased by opening an air inlet valve associated with the designated region and closing air inlet valves associated with each other region.

10. The fuel system of claim 7, wherein the canister includes four regions and four air inlet valves corresponding to the four regions.

11. The fuel system of claim 10, wherein two pairs of air inlet valves are located on opposing sides of the canister.

12. The fuel system of claim 7, wherein the canister includes two purge outlets located on opposing sides of the canister.

13. The fuel system of claim 7, wherein the at least one purge outlet is located on a different side of the canister from a plurality of air inlet valves.

14. A canister for storing fuel vapors comprising:

a canister inlet fluidly coupled with a fuel tank;

a first purge outlet and a second purge outlet fluidly coupled with an intake manifold, the first purge outlet and the second purge outlet being located on opposing sides of the canister;

a plurality of air inlet valves associated with a plurality of regions of the canister, each of the plurality of air inlet valves being individually operable to purge fuel vapors from an associated region to the first purge outlet or the second purge outlet; and a controller including a processor and computer readable medium having non-transitory instructions stored in memory that when executed by the processor:

sequentially purge fuel vapors from each of the plurality of regions of the canister, where purging a region includes opening an air inlet valve associated with that region and maintaining air inlet valves associated with each other region closed to direct fuel vapors to the at least one purge outlet, wherein the first and second purge outlets are located on opposing sides of the canister, and on different sides of the canister from the plurality of air inlet valves.

15. The fuel system of claim 14, wherein the plurality of air inlet valves includes two pairs of air inlet valves located on opposing sides of the canister.

* * * * *